United States Patent [19]

Jacobs et al.

[11] Patent Number: 4,748,480

[45] Date of Patent: May 31, 1988

[54] CONTROLLED AUTHENTIC DOCUMENT RECOGNITION EQUIPMENT

[75] Inventors: Paul F. Jacobs, La Crescenta; Thomas A. Whatley, Northridge; John D. Worden, Mar Vista; William D. Green, Sunland; Kenneth I. Gustafson, Glendora, all of Calif.

[73] Assignee: Xerox Corporation, Stamford, Conn.

[21] Appl. No.: 61,257

[22] Filed: Jun. 12, 1987

[51] Int. Cl.[4] ..... G03G 15/00

[52] U.S. Cl. ..... 355/133

[58] Field of Search ..... 355/3 R, 3 SH, 133; 430/56

[56] References Cited

U.S. PATENT DOCUMENTS

| | | | |
|---|---|---|---|
| 3,816,118 | 6/1974 | Byrne | 430/56 |
| 4,486,090 | 12/1984 | Warhol | 355/133 X |
| 4,678,322 | 7/1987 | Finkel et al. | 355/133 |

*Primary Examiner*—Richard A. Wintercorn
*Attorney, Agent, or Firm*—Franklyn C. Weiss

[57] ABSTRACT

This invention relates to sensitive or classified documents utilizing specially prepared paper containing a unique substance which will, in the presence of sensors incorporated within a document copier which constantly monitor the field of view for the presence of this unique substance, interrupt the operation of this document copier. Within the copier housing, adjacent the illumination and optical apparatus, a lens gathers some of the reflected light from a document to be copied. This light is then passed through three (3) narrow band spectral filters to three (3) associated detectors. Subsequent circuitry responds to the detected light at the predetermined wavelengths, if present, and, when appropriate, interrupts the operation of the copier and/or sounds an alarm or triggers a camera.

9 Claims, 2 Drawing Sheets

CONTROLLED AUTHENTIC DOCUMENT RECOGNITION EQUIPMENT

The invention relates to the prevention of unauthorized xerographic reproduction of classified or proprietary documents. Specific features present in such documents are sensed which control the reprographic process by interrupting the operation of the copier.

BACKGROUND OF THE INVENTION

While document copiers have become prolific, there are certain situations where it becomes highly desirable to prevent the copying of specific originals. Such situations could occur, for example, with the illicit or unauthorized photocopying of classified or proprietary documents.

The problem of illicit photocopying of classified or proprietary documents has become pandemic. It would be highly desirable to be able to inhibit the xerographic or other type reproduction of sensitive documents. To do so requires that the photocopier be equipped with a detection and control system that will inhibit the copier automatically before the image can be captured electrostatically, unless a proper "enable" signal is received. This becomes especially important when the frequent occurrence of government espionage activities is considered in which illicit photocopies have been made of very highly classified documents. Recently, there have been a number of publicly reported cases wherein copies of information regarding battle plans, fleet dispositions, communication frequencies, corporate strategies, merger plans, sales histories/forecasts, new product development reports, etc., have been sold on the open market. The ability to prevent the unauthorized photocopying of selected documents becomes extremely important to both national security and the potential future of many corporate activities and entities.

One solution to this problem is disclosed in copending application Ser. No. 868,983, filed 5-30-86, assigned to the same assignee, now U.S. Pat. No. 4,678,322 wherein unique phosphors are applied to paper. The phosphors may be applied either to the surface of the paper in a post production facility, or incorporated into the paper during the last stages of paper manufacture. Another solution is disclosed in copending application Ser. No. 868,982, filed 5-30-86, and assigned to the same assignee, where embedded in or coated on the paper would be microscopic retroreflective spheres which would reflect a separate source of laser emitted light back to a photodetector in a copier, after passing through a filter at the wavelength of the light emitting laser. In both cases the detected signal would be used to interrupt the operation of the copier and/or other uses, such as sounding an alarm or triggering a camera.

BRIEF SUMMARY OF THE INVENTION

According to the present invention, sensitive or classified documents utilizing specially prepared paper containing a unique substance will, in the presence of sensors incorporated within a document copier which constantly monitor the field of view for the presence of this unique substance, interrupt the operation of this document copier. Within the copier housing, adjacent the illumination and optical apparatus, a lens gathers some of the reflected light from a document to be copied. This light is then passed through three (3) narrow band spectral filters to three (3) associated detectors. Subsequent circuitry responds to the detected light at the predetermined wavelengths, if present, and, when appropriate, interrupts the operation of the copier.

DESCRIPTION OF THE DRAWINGS

For a more complete understanding of the invention, reference may be had to the following detailed description of the invention in conjunction with the drawings wherein.

DETAILED DESCRIPTION OF THE INVENTION

This invention describes a concept for the detection and prevention of illicit copies of sensitive or classified documents. The invention, known as CADRE TM, Controlled Authentic Document Recognition Equipment utilizes specially prepared paper containing a unique substance, and a sensor incorporated within the copier housing which continuously monitors the field of view for the presence of this special paper. If the sensor detects only the platen glass and/or cover, nothing happens. Furthermore, if the sensor detects ordinary paper, plastic, or other substrates which do not contain the special substance, nothing happens and an individual is free to make as many copies as desired or permitted. However, if a sensitive document, which was printed on the special paper, is submitted for reproduction, the sensor detects the presence of the unique substance and immediately interrupts the copier. In addition, the sensor can be connected to such devices as electronic locks, cameras or alarm systems.

Figure 1:
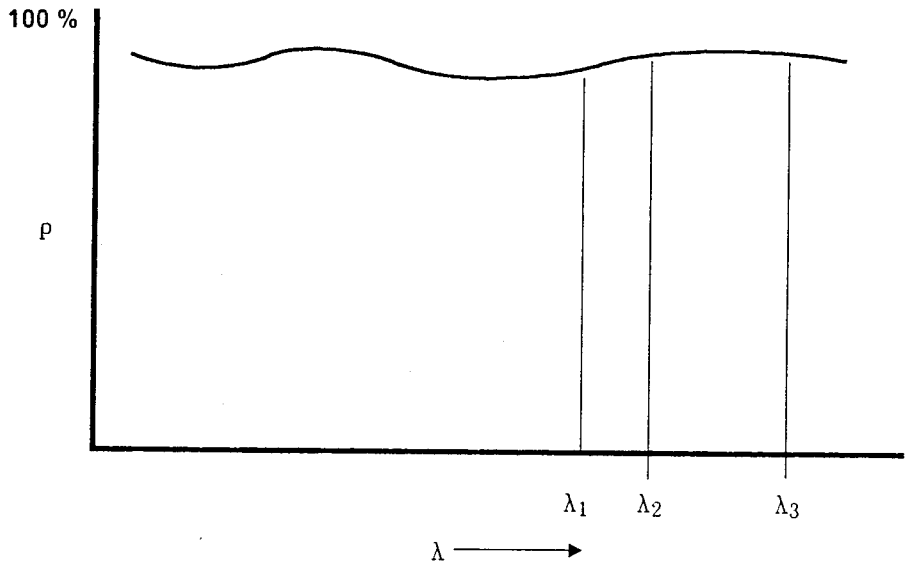
FIG. 1 is a curve representative of the reflectivity versus wavelength for white paper.

FIG. 1 shows the reflectivity, $\rho$, of a piece of white paper as a function of wavelength, $\lambda$. The curve, $\rho(\lambda)$, is basically flat. At three critical wavelengths, $\lambda_1$, $\lambda_2$, and $\lambda_3$, the sensor samples the reflectivity values, $\rho(\lambda_1)$, $\rho(\lambda_2)$, and $\rho(\lambda_3)$ and forms the two ratios:

$$R_{1,2} \equiv \rho(\lambda_1)/\rho(\lambda_2)$$

and $$R_{3,2} \equiv \rho(\lambda_3)/\rho(\lambda_2)$$

Obviously, if the curve were perfectly flat, then both ratios would be exactly unity. Provided $R_{1,2} < T_{1,2}$ and $R_{3,2} < T_{3,2}$ where $T_{1,2}$ and $T_{3,2}$ are preset threshold values then no interrupt signal is sent to the copier. Thus, for plain white paper, the copier will function normally.

Figure 2:
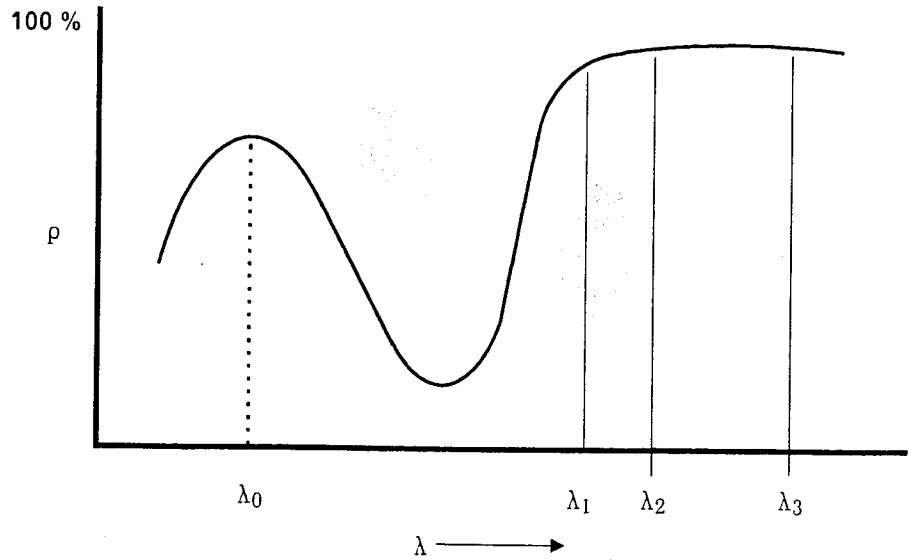
FIG. 2 is a curve representative of the reflectivity versus wavelength for blue paper.

FIG. 2 shows the reflectivity, $\rho(\lambda)$, of a piece of ordinary blue paper as a function of wavelength. The curve, $\rho(\lambda)$, has a peak at wavelength $\lambda = \lambda_0$ and a valley between $\lambda_0$ and $\lambda_1$. This structure of $\rho(\lambda)$ accounts for the blue appearance of the paper. Nonetheless, despite this structure of the reflectivity function, at the three critical wavelengths, $\lambda_1$, $\lambda_2$, and $\lambda_3$, the function is still very flat. Thus, $$R_{1,2} < T_{1,2}$$

and $$R_{3,2}<T_{3,2}$$

and the copier will still function normally. The same would be true for any color of paper, plastic, or other substrates (i.e., blue, yellow, green, pink, beige, etc.). The only constraint is that the curve be essentially flat between $\lambda_1$ and $\lambda_3$ such that $\rho(\lambda_1)$ and $\rho(\lambda_3)$ are approximately equal to $\rho(\lambda_2)$.

Figure 3:
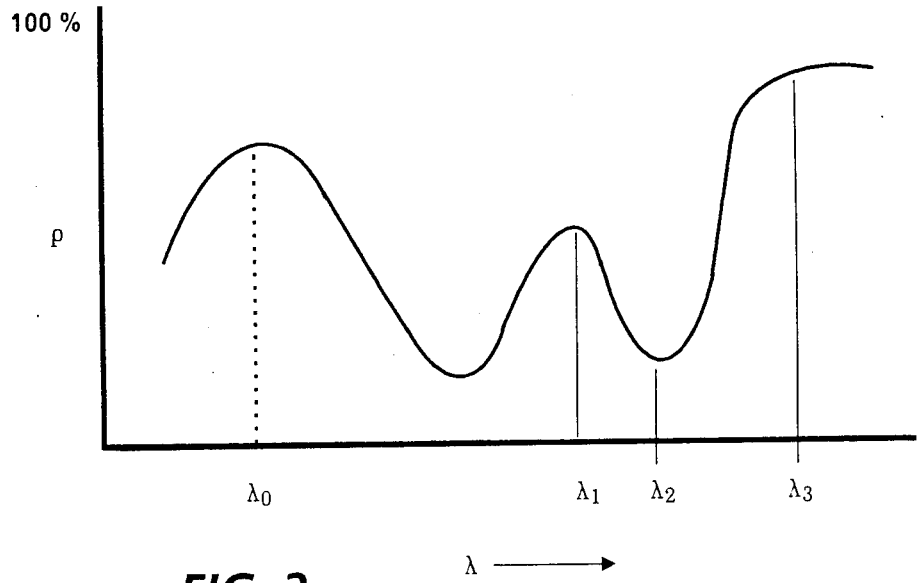
FIG. 3 is a curve representative of the reflectivity versus wavelength for the special paper disclosed herein.

FIG. 3, however, shows the reflectivity function, $\rho(\lambda)$, for the special paper of the present invention. Because the function, $\rho(\lambda)$, has a visible peak at $\rho(\lambda_o)$, it appears blue to the human eye. However, this is not important to the basic concept. What is critical is the fact that $\rho(\lambda_2)$ is significantly smaller than $\rho(\lambda_1)$ and $\rho(\lambda_3)$. Therefore $$R_{1,2}\equiv\rho(\lambda_1)/\rho(\lambda_2)>T_{1,2}$$

and $$R_{3,2}\equiv\rho(\lambda_3)/\rho(\lambda_2)>T_{3,2}$$

Since both conditions, namely, $R_{1,2}>T_{1,2}$ and $R_{3,2}>T_{3,2}$ obtain, then an interrupt signal is sent from the sensor to the copier (and, if desired, to a lock, camera, and/or alarm). The interrupt signal disables the copier, so that no copy is made.

A family of chemical compounds exists which has significant absorption in certain unique spectral regions. These compounds were originally developed for use in the production of xerographic photoreceptors and may be described as compositions having four isoindole groups linked by four nitrogen atoms in such a manner so as to form a conjugated chain. See U.S. Pat. No. 3,816,118. However, several of these compounds have applicability in the present invention. One such compound is nontoxic, has a strong absorption signature, is economical and, when suitably ground and prepared, is very compatible with paper production as a surface coating. This compound has a blue color to the eye. Thus, when it was used as the basis of the present invention, the special paper would have a light blue appearance. This has no effect whatsoever on its performance, but does have an additional advantage. Since all sensitive information intended to be protected by the present invention would be generated on light blue paper, no one other than a blind person would have a viable excuse when caught making an illicit copy.

Figure 4:
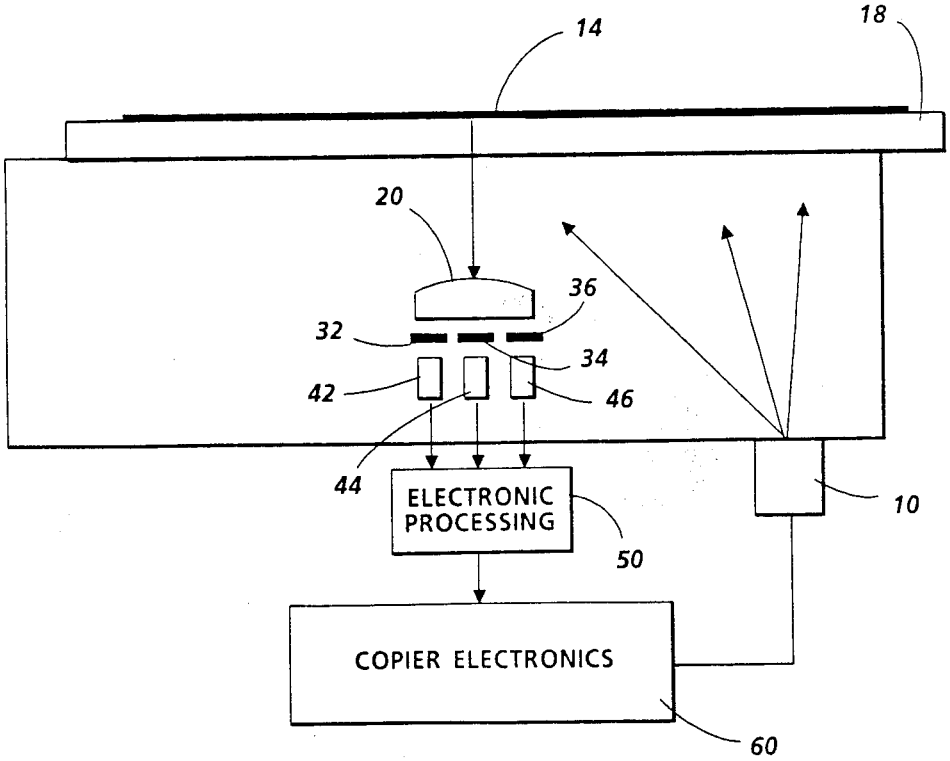
FIG. 4 is a block diagram of the system utilizing the principles of the present invention.

FIG. 4 shows a light source 10, which may be part of the copier. When the light source flashes, photons pass through the photocopier glass platen and reach the special paper 14. At $\lambda=\lambda_1$, more light is reflected than at $\lambda=\lambda_2$. Similarly, at $\lambda_3$ more light is reflected than at $\lambda=\lambda_2$. An optical imaging lens 20 focuses light from paper 14 through three narrow band spectral filters 32, 34, 36, and which transmit significant radiation only at wavelengths $\lambda_1$, $\lambda_2$, and $\lambda_3$, respectively, onto detectors 42, 44, 46. The signals from detectors 42, 44, 46 go to an electronic processing module 50 which forms the two ratios, $$R_{1,2}\equiv\rho(\lambda_1)/\rho(\lambda_2)$$

and $$R_{3,2}\equiv\rho(\lambda_3)/\rho(\lambda_2)$$

and then determines if $R_{1,2}>T_{1,2}$ and $R_{3,2}>T_{3,2}$. If either or both ratios are less than the preset threshold values, a signal is sent from module 50 to electronics 60, which allows the copier process to continue. However, if both ratios exceed their respective thresholds, then a disable signal is sent from module 50 to electronics 60 which interrupts the copier process. This procedure thereby thwarts illicit copying, providing the originals of all sensitive or classified documents are generated on the special paper described herein.

The detectors are standard uncooled Silicon Photovoltaic detectors (as supplied by Infrared Industries). The filters are narrow bandpass, near infra-red, interference filters (as supplied by Barr Associates). The filters, however, could be customized for CADRE, having specific central wavelengths, center wavelength transmission levels, and Full-Width-at-Half-Maximum (FWHM) values. The detectors are standard off-the-shelf items.

While the invention has been described with reference to a specific embodiment, it will be understood by those skilled in the art that various changes may be made and equivalents may be substituted for elements thereof without departing from the true spirit and scope of the invention. In addition, many modifications may be made without departing from the essential teachings of the invention.

What is claimed is:

1. Apparatus for preventing the unauthorized reproduction of classified, or proprietary, or other documents on a photocopier comprising:

means adjacent the illumination and/or optical apparatus of said photocopier for detecting light reflected from said document, said detecting means being independent of the normal document reproduction apparatus, said detecting means including lens means for gathering and focussing some of the reflected light from a document on said photocopier to be copied, a plurality of spectral filter means receiving said focussed light and responsive to predetermined frequency bands to respond to a predetermined chemical compound group.

means responsive to the light transmitted by said spectral filter means for generating electrical signals to at least interrupt the operation of said photocopier.

2. The apparatus as set forth in claim 1 wherein said plurality of spectral filter means includes at least three spectral filters responsive to three separate wavelengths of light reflected from said document, said three separate wavelengths being identifiable with said predetermined chemical compound group.

3. The apparatus as set forth in claim 2 wherein said chemical compound group is coated on or made in the paper stock of said document to be copied such that such documents render the copier inoperative and/or initiate other actions.

4. The apparatus as set forth in claim 2 wherein said chemical compound group being from a family of compositions having four isoindole groups linked by four nitrogen atoms in such a manner as to form a conjugated chain.

5. A method of preventing or monitoring the unauthorized reproduction of classified, or proprietary, or other documents on a photocopier comprising generating a source of light to illuminate a document to be copied detecting light reflected from said document, said light detection being independent of the normal document reproduction apparatus, said step of detecting including gathering and focussing some of the detected light reflected from said document to be copied, filtering said focussed light and responsive to predetermined frequency bands of light which correspond to a predetermined chemical compound group, and generating electrical signals to at least interrupt the operation of said photocopier upon detection of said light reflected in correspondence to a predetermined chemical compound group.

6. The method as set forth in claim 5 further including coating or manufacturing the paper stock of said document to be copied with said chemical compound group, wherein said compound group comprises a family of compositions having four isoindole groups linked by four nitrogen atoms in such a manner as to form a conjugated chain.

7. The method as set forth in claim 6 wherein said step of filtering includes providing at least three filters responsive to three separate wavelengths of light reflected from said document to be copied, said three separate wavelengths being identifiable with said predetermined chemical compound group.

8. Apparatus for preventing the unauthorized reproduction of classified, or proprietary, or other documents on a photocopier comprising:

means adjacent the illumination and/or optical apparatus of said photocopier for detecting light reflected from said document, said detecting means being independent of the normal document reproduction apparatus, said detecting means including lens means for gathering and focussing some of the reflected light from a document on said photocopier to be copied, a plurality of spectral filter means receiving said focussed light and responsive to predetermined frequency bands to respond to a predetermined chemical compound group, and means responsive to the light transmitted by said spectral filter means for generating electrical signals to interrupt the operation of said photocopier and/or initiate other actions.

9. A method of preventing or monitoring the unauthorized reproduction of classified, or proprietary, or other documents on a photocopier comprising generating a source of light to illuminate a document to be copied, detecting light reflected from said document, said light detection being independent of the normal document reproduction apparatus, said step of detecting including gathering and focussing some of the detected light reflected from said document to be copied, filtering said focussed light and responsive to predetermined frequency bands of light which correspond to a predetermined chemical compound group, and generating electrical signals to interrupt the operation of said photocopier and/or initiate other actions upon detection of said light reflected in correspondence to a predetermined chemical compound group.

* * * * *